US007347646B2

(12) United States Patent
Legge et al.

(10) Patent No.: US 7,347,646 B2
(45) Date of Patent: Mar. 25, 2008

(54) GEOTECHNICAL BARRIER

(75) Inventors: Kelvin Robert Legge, Centurion (ZA); Petrus Johannes Meyer, Van Riebeeck Park (ZA)

(73) Assignee: Aquatan (Pty) Limited, Isando (ZA)

( * ) Notice: Subject to any disclaimer, the term of this patent is extended or adjusted under 35 U.S.C. 154(b) by 0 days.

(21) Appl. No.: 10/529,534

(22) PCT Filed: Sep. 30, 2003

(86) PCT No.: PCT/IB03/04287

§ 371 (c)(1),
(2), (4) Date: Mar. 29, 2005

(87) PCT Pub. No.: WO2004/029367

PCT Pub. Date: Apr. 8, 2004

(65) Prior Publication Data

US 2006/0002764 A1 Jan. 5, 2006

(30) Foreign Application Priority Data

Sep. 30, 2002 (ZA) ..... 2002/7816
Sep. 30, 2002 (ZA) ..... 2002/7817

(51) Int. Cl.
*B09B 1/00* (2006.01)

(52) U.S. Cl. ..... 405/129.57; 405/129.45

(58) Field of Classification Search ..... 405/129.45, 405/129.55, 129.57, 129.6, 129.7, 302.7, 405/129.75

See application file for complete search history.

(56) References Cited

U.S. PATENT DOCUMENTS

| | | | | |
|---|---|---|---|---|
| 4,335,978 | A | 6/1982 | Mutch | |
| 4,439,062 | A | 3/1984 | Kingsbury | |
| 4,462,184 | A * | 7/1984 | Cunningham | 47/58.1 R |
| 4,916,937 | A * | 4/1990 | Robertson et al. | 405/270 |
| 5,091,234 | A * | 2/1992 | McGroarty et al. | 428/143 |
| 5,215,409 | A | 6/1993 | Jax et al. | |
| 5,258,303 | A * | 11/1993 | Stenger | 435/262 |
| 5,335,535 | A | 8/1994 | Ruthrof et al. | |
| 5,848,856 | A * | 12/1998 | Bohnhoff | 405/36 |

FOREIGN PATENT DOCUMENTS

| | | | |
|---|---|---|---|
| DE | 3435983 A1 | | 1/1986 |
| WO | WO 99/01619 | * | 1/1999 |

OTHER PUBLICATIONS

Nagel, D: "Deponie-Abdichtung mit PE-HD Kunststoffdichtungsbahnen" 4577 Mull und Abfall, Schmidt Verlag, Berlin, DE, vol. 23 (1991) Jan. No. 1.

* cited by examiner

*Primary Examiner*—John Kreck
(74) *Attorney, Agent, or Firm*—Marshall, Gerstein & Borun LLP

(57) ABSTRACT

A geotechnical barrier includes a first barrier layer; a second barrier layer overlying the first barrier layer and spaced therefrom, the first and second barrier layers defining, at least in part, a fluid passageway having an inlet and an outlet; and fluid displacement means for displacing a fluid through said fluid passageway from the inlet to the outlet. The invention extends to method for constructing and operating a geotechnical barrier and to a geosynthetic barrier and a geocomposite geosynthetic barrier.

60 Claims, 2 Drawing Sheets

GEOTECHNICAL BARRIER

FIELD OF THE INVENTION

This invention relates to a barrier and to a method for constructing and operating a barrier. In particular, the invention relates to a geotechnical barrier and method for constructing and operating such a barrier. The invention relates particularly, but not exclusively, to a geotechnical barrier for use in landfill sites, waste sites, and the like.

BACKGROUND TO THE INVENTION

Large-scale barrier systems which consist of several layers of geotechnical or geosynthetic materials each having varying liquid and gas permeability characteristics are well known. Such barrier systems are, typically, used to prevent or at least inhibit contamination of an underlying substrate and, consequently, of groundwater in the region of landfill and similar sites by toxic or dangerous waste products, which are either stored in the waste site or generated by the material dumped in the waste site.

In many instances geosynthetic clay liners ("GCL") are used in conjunction with other materials of either non-synthetic or synthetic origin to form the barrier. Commonly, Bentonite is used in the clay liner while the other materials are of either non-synthetic or synthetic nature. Such synthetic barrier materials include flexible geomembranes of polyethylene or polypropylene or other plastics materials. The installation of a low permeability or quasi-impermeable geotechnical barrier commonly involves the laying of an under layer of relatively low permeability, such as a clay soil, or a geomembrane, on prepared substrate. (It is to be understood that the term "under", when used in this specification in relation to a membrane or layer forming part of a barrier refers to the membrane or layer furthest from the landfill or potentially contaminating material and the term "upper" refers to the membrane or layer closest to the landfill or potentially contaminating material. Further, the term "layer" shall be given a wide interpretation to include a composite layer comprising a number of sub-layers or components, as well as a single layer of a homogeneous material.) This under layer is then covered with a material that facilitates drainage, such as stones or an aggregate or a geospacer of a synthetic material. Such a spacer comprising a cuspated membrane is disclosed in the applicant's pending South African Patent Application No. 2003/6398, which is incorporated herein in its entirety by reference. The drainage layer is characterized by having a high permeability. The drainage layer is then covered with a GCL which is, in turn, covered with an upper layer of relatively low permeability, which is typically also either a clay soil or a geomembrane.

To utilize this low permeability or quasi-impermeable barrier to its full potential the Bentonite or clay in the GCL needs to be hydrated. This enhances the impermeability of the impermeable barrier system and is particularly important where the GCL may be exposed to leachate or salts, as in the case where the barrier is used in a landfill site. Conventionally, hydration of the GCL is performed before the upper geomembrane or layer is positioned. Where a geomembrane is used, it must be secured in place after positioning. The under and upper geomembranes may be secured in a number of different ways, depending on the type of geomembrane utilized. The different securing methods will not be described in this specification. Laying the upper geomembrane or layer after the GCL has been hydrated may cause mechanical damage to the GCL. In addition, the Bentonite is often squeezed from the GCL due to loads exerted during the laying (and welding) of the upper geomembrane. For this reason, in many installations the GCL is not hydrated, resulting in a reduction in the reliability and performance of the GCL. Difficulties with hydration of the GCL are magnified where the GCL is located on a slope. In summary, in conventional geotechnical barriers using GCLs there is a problem of the hydration of the GCL. Further, performance of the barrier is improved if the GCL can be re-hydrated, either continually or at appropriate intervals.

Generally, the layers of low permeability, whether non-synthetic or synthetic, used in the geotechnical barriers described are at least partially permeable, particularly to substances such as volatile organic compounds. These compounds are particularly harmful and should, if possible, be prevented from contaminating the environment in which the waste site is situated. In barriers of the sort described above, volatile organic compounds, toxic liquids and other contaminants penetrating or permeating or diffusing through the upper membrane or layer of the barrier will collect in the space or passageway provided by the drainage layer. If not removed, they may then eventually permeate the under layer. Thus, this fluid passageway acts, to some extent, as a temporary reservoir for volatile gasses and toxic liquids. It would be an advantage to be able to remove these contaminants from the fluid passageway, either on a continual basis or at appropriate intervals.

In this specification, the word "passageway" shall be given a wide meaning and shall apply to any space providing a fluid flow path, irrespective of its shape. A passageway shall also include a region of high fluid permeability/transmissivity and shall include a drain.

Further, the geosynthetic membranes used in geotechnical barriers are required to be installed, as far as possible, without creases, folds or breaks. To achieve this, it is often necessary to cut and weld the membrane after laying. It would be an advantage to be able to treat the membrane so that it tends to conform to the shape of the associated substrate without requiring substantial cutting, welding and similar after-laying treatment.

Still further, geosynthetic membranes exposed to the sun during installation may be heated to a high temperature. In addition, decomposition of material in waste sites may generate high temperatures. Such high temperatures may shorten the life of the membrane or reduce its geotechnical performance. Accordingly, it would be a further advantage to be able to reduce or control the operating temperature of the membranes, either during installation or during use.

OBJECT OF THE INVENTION

It is an object of this invention to provide a geotechnical barrier and a method of constructing and operating such a barrier that alleviates, at least partially, the abovementioned disadvantages and provides the advantages set out above.

SUMMARY OF THE INVENTION

According to a first aspect of the invention there is provided a geotechnical barrier, the barrier including

- a first barrier layer;
- a second barrier layer overlying the first barrier layer and spaced therefrom, the first and second barrier layers defining, at least in part, a fluid passageway having an inlet and an outlet; and
- fluid displacement means for displacing a fluid through said fluid passageway from the inlet to the outlet.

The geotechnical barrier may include spacing means for spacing the first barrier layer from the second barrier layer. The spacing means may comprise a drainage layer of at least one non-synthetic material. Instead, the spacing means may be of a geosynthetic material. Then, the spacing means may comprise a cuspated membrane of a plastics material or other geosynthetic drain.

The first and second barrier layers may comprise non-synthetic geotechnical materials. Instead, the first and second barrier layers may comprise geosynthetic materials. At least one of the first and second barrier layers may be a geocomposite barrier layer. The geocomposite layer may comprise a geocomposite clay liner, the clay layer thereof being in fluid communication with the fluid passageway.

The fluid displacement means may be operably connected to the outlet of the fluid passageway and may be operable to provide a negative pressure at the outlet with respect to the pressure at the inlet. The fluid displacement means may comprise a vacuum pump, fan, compressor, a venturi-based pumping means, siphon, or any suitable displacement means which is located at the outlet of the fluid passageway.

The fluid may comprise air. Instead, the geotechnical barrier may include entrainment means connected at the inlet of the fluid passageway for entraining a substance into an air stream provided at the inlet, to provide a fluid for displacement through the fluid passageway comprising a mixture of air and the said substance. Then, the substance may be water.

Further, the geotechnical barrier may include a temperature control means for controlling the temperature of the fluid introduced at the inlet of the fluid passageway.

The outlet may be connected to a disposal means for disposing of the fluid and any contaminants entrained therein extracted at the outlet.

According to a second aspect of the invention there is provided a method for constructing and operating a geotechnical barrier, the method including providing a first barrier layer;

providing a second barrier layer overlying the first barrier layer and spaced therefrom, the first and second barrier layers defining, at least in part, a fluid passageway having an inlet and an outlet; and displacing a fluid through said fluid passageway from the inlet to the outlet.

The method may include providing spacing means for spacing the first barrier layer from the second barrier layer. Then, the spacing means may comprise a drainage layer of at least one non-synthetic material. Instead, the spacing means may be of a geosynthetic material. The spacing means may comprise a cuspated membrane or geosynthetic drain of a plastics material. The cuspated membrane may comprise a plastics material sheet that has a multiplicity of projections extending for one side thereof. Further, the projections may be hollow and the majority of the hollow projections may be filled with a material to inhibit collapse of the projections under compressive forces.

The first and second barrier layers may comprise non-synthetic geotechnical materials. Instead, the first and second barrier layers may comprise geosynthetic materials. At least one of the first and second barrier layers may be a geocomposite barrier layer. Then, the geocomposite layer may comprise a geocomposite clay liner, the clay layer thereof being in fluid communication with the fluid passageway.

The step of displacing the fluid from the inlet to the outlet may comprise providing a negative pressure at the outlet with respect to the pressure at the inlet.

The fluid may comprise air or water. Instead, the method may include entraining a substance into an air stream provided at the inlet, to provide a fluid for displacement through the fluid flow passageway comprising a mixture of air and the said substance. Then, the substance may be water.

The method may further include controlling the temperature of the fluid introduced at the inlet of the fluid passageway.

Further, the method may include the step of disposing of the fluid and any contaminants entrained therein extracted at the outlet.

According to a third aspect of the invention there is provided a geosynthetic barrier, the barrier including a first geosynthetic membrane;

a second geosynthetic membrane overlying the first membrane and peripherally sealed thereto;

spacer means intermediate the first and second membranes to space the said membranes apart, the first and second membranes thereby defining a fluid passageway;

an inlet to the fluid passageway defined on at least one of the first and second membranes;

an outlet to the fluid passageway defined on at least one of the first and second membranes; and fluid displacement means for displacing a fluid through said fluid passageway from the inlet to the outlet.

According to a fourth aspect of the invention there is provided a geocomposite geosynthetic barrier, which includes a first geosynthetic membrane;

a geocomposite clay liner comprising a second geosynthetic membrane and a clay liner, the first and second geosynthetic membranes being peripherally sealed to one another with the clay liner therebetween;

spacer means intermediate the first membrane and the clay liner to space the said membranes apart, thereby defining a fluid passageway between the first membrane and the clay liner;

an inlet to the fluid passageway defined on at least one of the first and second membranes;

an outlet to the fluid passageway defined on at least one of the first and second membranes; and fluid displacement means for displacing a fluid through said fluid passageway from the inlet to the outlet.

According to a fifth aspect of the invention there is provided a method for flushing contaminants from a geotechnical barrier comprising at least two barrier layers and having a fluid passageway defined therebetween, the method including displacing a fluid through said fluid passageway to entrain contaminants that have penetrated one of the barrier layers in a fluid flowstream.

According to a sixth aspect of the invention there is provided a method for hydrating a clay liner of a geotechnical barrier comprising first and second barrier layers one of which includes a clay liner, the method including displacing a hydrating fluid through a fluid passageway defined between the clay liner and the other of the barrier layers.

BRIEF DESCRIPTION OF DRAWINGS

The invention is now described, by way of example only, and with reference to the accompanying diagrammatic drawings, in which.

DETAILED DESCRIPTION OF THE INVENTION

Figure 1:
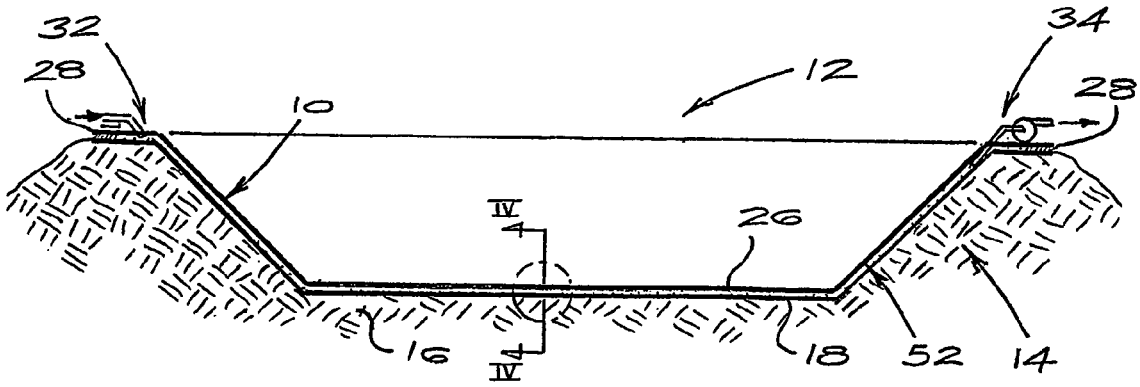
FIG. 1 shows a cross sectional view of an impermeable barrier in accordance with an aspect of the invention, in use.

In the drawings, a geotechnical barrier in accordance with the invention is indicated generally by reference numeral 10.

The barrier 10 is used to inhibit contamination of the environment surrounding a waste site 12. The waste site 12 is prepared by providing a containment structure 14, generally in the form of a dam. A substrate 16 is prepared for laying of the geotechnical barrier 10.

In the embodiment shown in FIGS. 1 to 4, the geotechnical barrier 10 is a geosynthetic barrier comprising a first, under membrane 18 of a plastics material which is laid upon the substrate 16, to conform to the contours of the containment structure 14. Once the under membrane 18 is in place and the seams thereof have been welded or otherwise adhesively sealed, a drainage layer 20 is laid upon the under membrane 18. The drainage layer 20 comprises a stone aggregate 22. However, it will be appreciated that the drainage layer 20 may be provided by means of a geospacer, such as a net or cuspated membrane of a synthetic plastics material or other suitable material. Once the drainage layer 20 is in place, a geocomposite clay liner (GCL) 24 is laid in place upon the drainage layer 20. The geocomposite clay liner comprises a low hydraulic conductivity earth material, such as clay or bentonite, in an assembled structure which includes geosynthetic materials. The structure of the geocomposite liner is not shown in detail in the drawings, as such liners are well known to persons skilled in the art to which the invention relates. The bentonite layer of the GCL 24 is in contact with the drainage layer 20 and in fluid communication therewith. Finally, a further upper geosynthetic membrane 26 is laid upon the GCL 24 and is secured in place. The securing of the geomembranes 18,26 may be variously achieved, depending on the type of geomembrane utilized, and therefore the different securing methods will not be described in this embodiment.

Figure 2:
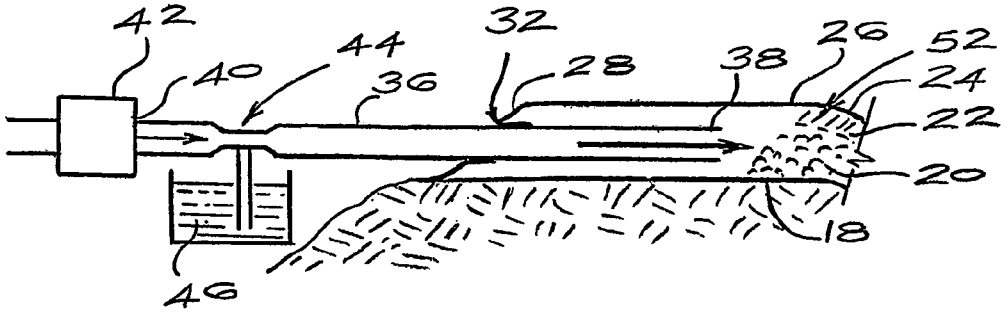
FIG. 2 shows a cross sectional detail of an inlet portion of the barrier of FIG. 1.
Figure 3:
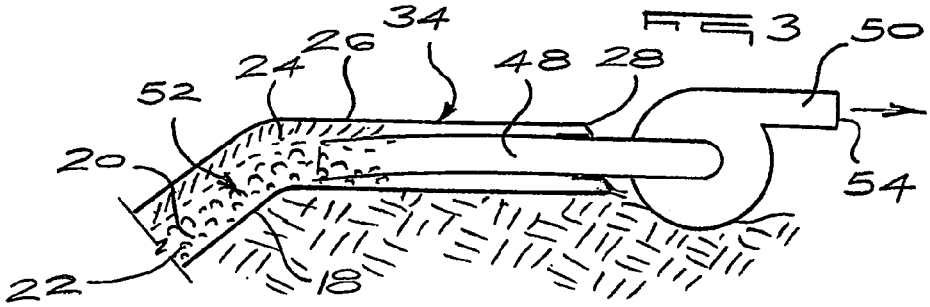
FIG. 3 shows a cross sectional detail of an outlet portion of the barrier of FIG. 1.
Figure 4:
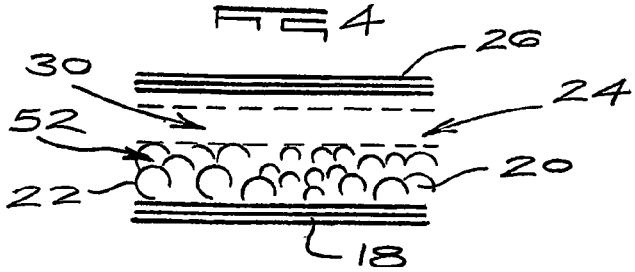
FIG. 4 shows a cross sectional detail of the layers of the barrier of FIG. 1.

The under and upper geosynthetic membranes 18,26 are peripherally sealed to one another at their edges 28 to provide an enclosed volume 30 therebetween. The barrier 10 has at least one inlet 32 defined at its sealed edge 28 and at least one outlet 34 defined at an opposed portion of its sealed edge 28. As shown in FIG. 2, an inlet pipe 36 is arranged at the inlet 32, a first end 38 of the inlet pipe 36 being in communication with the drainage layer 20, and a second end 40 of the inlet pipe 36 being attached to a temperature control facility 42, which, in turn, draws air from the atmosphere. A venturi mechanism 44 is provided intermediate the first end 38 of the inlet pipe 36 and the temperature control facility 42 and a water reservoir 46 is provided to feed into the air stream within the inlet pipe 36. It will thus be appreciated that the flow of air through the inlet pipe 36 will result in the drawing of water into the air stream in the inlet pipe 36 from the water reservoir 46, thereby entraining the water in the air stream.

At the outlet 34 of the barrier 10, an outlet pipe 48 is connected to a vacuum pump 50 and is in communication with the drainage layer 20. It will be appreciated that the enclosed drainage layer 20 with its inlet 32 and outlet 34 thereby provides a fluid passageway 52 through which a fluid may be displaced between the inlet 32 and the outlet 34. The vacuum pump 50 creates a negative fluid pressure at the outlet 34 of the fluid passageway 52 with reference to the fluid pressure at the inlet 32. Accordingly, on operation of the vacuum pump 50, moisture-laden air is drawn into the fluid passageway 52, which is in fluid communication with the bentonite of the GCL 24. In this manner, the bentonite of the clay liner 24 may be hydrated after installation of the barrier 10. Further, rehydration of the bentonite layer may be accomplished from time to time or on a continuous basis, as required.

It will be appreciated that the inlet 32 and the outlet 34 may be relocated along the barrier 10 to evenly hydrate the bentonite in the GCL 24. Thus, the inlet 32 may be an region comprising a large opening in one of the geomembranes. It will be further appreciated that the relocation of the inlet 32 and the outlet 34 may be avoided by the providing multiple inlets and outlets having valves (not shown) at pre-selected positions on the barrier 10.

Those familiar with the installation of geosynthetic membranes, will appreciate that the upper membrane 26, having been laid in place, will generally contain creases and folds which must be removed in order to provide an effective and long lasting barrier. This is generally accomplished by the cutting and welding of the membrane 26. However, this process is cumbersome and time consuming and is also likely to lead to mechanical damage to the GCL 24. In many circumstances, the upper geosynthetic membrane 26 may achieve a relatively high temperature during installation, of the order of 80° C., as a result of radiation from the sun. The introduction of air at the inlet 32 at ambient temperature may, depending on the circumstances, provide a coolant for the upper membrane 26, resulting in shrinkage of the membrane 26 and the at least partial removal of creases, folds, and the like. Further, by means of the temperature control facility 42, the temperature of the air may be further reduced from the ambient temperature for the purpose of cooling the upper geosynthetic membrane 26. It will be appreciated that the operating characteristics and durability of the upper geosynthetic membrane 26, in particular, and also the GCL 24 may be temperature dependant. The temperature may be controlled by the temperature control facility 42 with a view to optimizing the lifespan and operating parameters of the membranes 18,26 and other components of the barrier 10. It is anticipated that in a preferred embodiment of the invention, the cooling facility 42 will operate in a range of between 0 and 100° C. Further, as required, the temperature of the air at the inlet 32 may be controlled to facilitate saturation thereof with water for hydration of the GCL 24.

Additives may be entrained in the fluid flow at the inlet 32. Thus, the fluid may comprise simply an air/water mixture. However, other chemicals may be introduced for the treatment and rejuvenation of the various layers of the barrier 10.

The outlet 54 of the vacuum pump 50 may be connected to a waste disposal system (not shown) for the removal and disposal of contaminants contained in the fluid exhausted at the outlet 34 of the passageway 52 of the barrier 10. It will be appreciated that the flow of a fluid, in this case an air/water mixture, through the fluid passageway 52 will entrain contaminants, particularly in the form of volatile organic compounds or other toxic fluids, which have penetrated the upper geosynthetic membrane 26 and are, for the time being, located in the fluid passageway 52. In this way, particularly harmful compounds may be inhibited from penetrating the barrier 10 to the surrounding environment. The entrained compounds may be removed for disposal or may be recycled into the waste area of the waste site 12. Further, analysis of the fluid exhausted may facilitate the detection of leaks in the barrier 10 and the composition of compounds penetrating the barrier 10.

Figure 5:
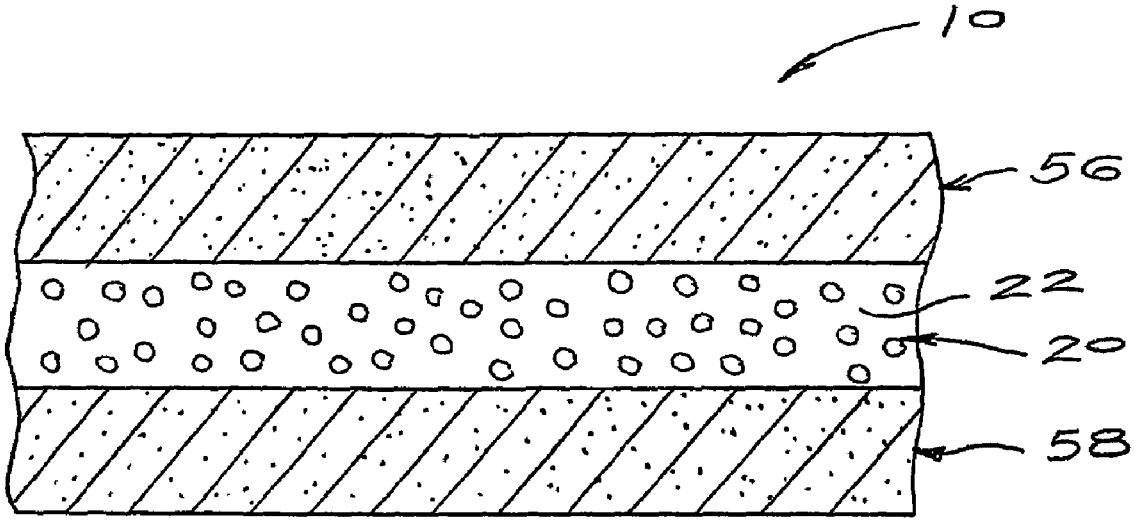
FIG. 5 shows a cross sectional detail of the layers of a further embodiment of the barrier system.

In FIG. 5, a further embodiment of the geotechnical barrier 10 is shown and, with reference to FIGS. 1 to 4, like reference numerals refer to like components, unless otherwise stated. The barrier 10 is similar to that described above, with the exception that in place of the geomembranes 18,26 the upper and under layers of the barrier are provided by semi-impervious layers, 56 and 58 respectively, of one or more materials which may be either non-synthetic or synthetic. The upper and under layers 56,58 are typically materials which are impermeable or have a low permeability. For example, soil of a permeability of $10^{-6}$ cm/s to $10^{-8}$ cm/s or a GCL having a permeability of the order of $10^{-9}$ cm/s (geomembranes typically have a permeability of the order of $10^{-14}$ cm/s). Where the drainage material is of stone or sand, it will commonly have a permeability of the order of $10^{-1}$ to $10^{-4}$ cm/s.

By means of the invention there is provided a geotechnical barrier suitable for use in waste and landfill sites, and the like, having a range of advantages. The barrier 10 allows for the hydration of an upper layer, which includes a GCL 24, after installation of an upper geomembrane 26 overlying the GCL 24.

This is achieved by introducing a fluid (either water or water saturated air) into the drainage layer 20 or space to saturate that area and hence hydrate the GCL 24. Since in such a case the application of a positive fluid pressure would tend to inflate the barrier 10, as with a balloon, and damage the installation, the introduction of the hydrating fluid by application of negative pressure is preferred. Further, where the overlying membrane is a geomembrane it is required that this membrane is flat to avoid folds and creases. In such a case the use of a fluid at a temperature well below ambient temperature would reduce the thermal expansion of the geomembrane 26 thereby cooling it and causing it to pull taught and hence flat, significantly simplifying the construction process. The temperature of a geomembrane exposed to sun readily achieves temperatures as high as 80° C. and drawing cooler air through the drainage layer 20 at 25° C., for example, would, it is believed, have a significant impact on reducing the thermal expansion of the membrane 26. Further, in landfills in which decomposition is taking place, temperatures in the waste mass of the order of 60° C. are readily achieved. Generally, the higher the temperature to which a geomembrane is exposed, the faster it will degrade. Thus, by maintaining or regularly reducing the temperature to which the overlying and underlying geomembranes 18,26 are exposed by introducing cool air throughout the life of the waste site (while decomposing) the lifespans of the geomembranes will be extended. Preferably, the temperature of the geomembranes 18,26 will be maintained at temperatures lower than 60° C. to approximate ambient temperatures of between about 10 and 25° C. A further advantage of drawing a fluid between the outer membranes or layers is the removal of volatile organic compounds which may diffuse through geomembrane layers, soil layers, and the like. Volatile organic compounds diffuse from an area of high concentration to an area of low concentration. Thus by continuously removing them from the drainage layer 20 a diffusion boundary is created and these compounds may be removed before they enter the environment. This is achieved by passing a fluid (in this case typically air) through the drainage layer 20 to remove such diffusing volatile organic compounds. After their exit they can be treated in a number of ways, including reintroducing them into the overlying waste mass or lagoon. The introduction of a fluid by way of saturated air requires that the temperature of the air stream is sufficiently high and generally higher than the ambient air temperature. Typically, once the upper geomembrane 26 has been covered with a pioneering layer or protective layer of sand or selected waste, the membrane 26 will be relatively cool and condensation will readily take place where the warmer saturated air strikes the cooler material of the upper membrane or layer.

The invention claimed is:

1. A geotechnical barrier, the barrier including a first barrier layer;

a second barrier layer overlying the first barrier layer and spaced therefrom, at least one of the first and second barrier layers being a geosynthetic barrier layer and the first and second barrier layers defining, at least in part, a fluid passageway having an inlet and an outlet; and fluid displacement means connected to the outlet and adapted to regularly provide a negative pressure at the outlet with respect to the pressure at the inlet, thereby to regularly displace a fluid through said fluid passageway from the inlet to the outlet.

2. A geotechnical barrier as claimed in claim 1, which includes spacing means for spacing the first barrier layer from the second barrier layer.

3. A geotechnical barrier as claimed in claim 2, in which the spacing means comprises a drainage layer of at least one non-synthetic material.

4. A geotechnical barrier as claimed in claim 2, in which the spacing means is of a geosynthetic material.

5. A geotechnical barrier as claimed in claim 4, in which the spacing means comprises a cuspated membrane of a plastics material.

6. A geotechnical barrier as claimed in claim 1, in which at least one barrier layer comprises a non-synthetic geotechnical material.

7. A geotechnical barrier as claimed in claim 1, in which the first and second barrier layers comprise geosynthetic materials.

8. A geotechnical barrier as claimed in claim 7, in which at least one of the first and second barrier layers is a geocomposite barrier layer.

9. A geotechnical barrier as claimed in claim 8, in which the geocomposite layer comprises a geocomposite clay liner, the clay layer thereof being in fluid communication with the fluid passageway.

10. A geotechnical barrier as claimed in claim 1, in which the fluid comprises air.

11. A geotechnical barrier as claimed in claim 10, which includes entrainment means connected at the inlet of the fluid passageway for entraining a substance into an air stream provided at the inlet, to provide a fluid for displacement through the fluid passageway comprising a mixture of air and the said substance.

12. A geotechnical barrier as claimed in claim 11, in which the substance is water.

13. A geotechnical barrier as claimed in claim 1, which includes a temperature control means for controlling the temperature of the fluid introduced at the inlet of the fluid passageway.

14. A geotechnical barrier as claimed in claim 1, in which the outlet is connected to a disposal means for disposing of the fluid and any contaminants entrained therein extracted at the outlet.

15. A geosynthetic barrier including a first geosynthetic barrier layer;

a second geosynthetic barrier layer;

spacer means intermediate the first and second barrier layers to space the said barrier layers apart, the first and second barrier layers thereby defining a fluid passageway and the fluid passageway having an inlet and an outlet; and fluid displacement means adapted to regularly displace a fluid through said fluid passageway from the inlet to the outlet.

16. A geosynthetic barrier as claimed in claim 15, in which the first barrier layer comprises a geosynthetic membrane.

17. A geosynthetic barrier as claimed in claim 16, in which the second barrier layer comprises a geosynthetic membrane.

18. A geosynthetic barrier as claimed in claim 16, in which the second barrier layer comprises a geocomposite clay liner comprising a second geosynthetic membrane and a clay liner, the clay liner being positioned intermediate the first and second geosynthetic membranes and the spacer means being positioned intermediate the first membrane and the clay liner to space the said membranes apart, thereby defining the fluid passageway between the first membrane and the clay liner.

19. A geosynthetic barrier as claimed in claim 17, in which the second geosynthetic membrane overlies the first geosynthetic membrane.

20. A geosynthetic barrier as claimed in claim 19, in which the first and second geosynthetic membranes are peripherally sealed to each other.

21. A geosynthetic barrier as claimed in claim 15, in which the spacing means comprises a drainage layer of at least one non-synthetic material.

22. A geosynthetic barrier as claimed in claim 15, in which the spacing means is of a geosynthetic material.

23. A geosynthetic barrier as claimed in claim 22, in which the spacing means comprises a cuspated membrane of a plastics material.

24. A geosynthetic barrier as claimed in claim 15, in which the fluid displacement means is connected to the outlet of the fluid passageway and is operable to provide a negative pressure at the outlet with respect to the pressure at the inlet, thereby to displace the fluid through said fluid passageway from the inlet to the outlet.

25. A geosynthetic barrier as claimed in claim 15, in which the fluid comprises air.

26. A geosynthetic barrier as claimed in claim 25, which includes entrainment means connected at the inlet of the fluid passageway for entraining a substance into an air stream provided at the inlet, to provide a fluid for displacement through the fluid passageway comprising a mixture of air and the said substance.

27. A geosynthetic barrier as claimed in claim 26, in which the substance is water.

28. A geosynthetic barrier as claimed in claim 15, which includes a temperature control means for controlling the temperature of the fluid introduced at the inlet of the fluid passageway.

29. A geosynthetic barrier as claimed in claim 15, in which the outlet is connected to a disposal means for disposing of the fluid and any contaminants entrained therein extracted at the outlet.

30. A method for constructing and operating a geosynthetic barrier, the method including providing a first barrier layer;

providing a second barrier layer, at least one of the first and second barrier layers being a geosynthetic barrier layer;

providing spacer means intermediate the first and second barrier layers to space the said barrier layers apart, the first and second barrier layers thereby defining a fluid passageway and the fluid passageway having an inlet and an outlet; and providing, regularly, a negative pressure at the outlet with respect to the inlet, thereby displacing, regularly, a fluid through said fluid passageway from the inlet to the outlet.

31. A method as claimed in claim 30, in which the at least one of the first and second layers being a geosynthetic barrier layer comprises a geosynthetic membrane.

32. A method as claimed in claim 31, in which the first barrier layer comprises a geosynthetic membrane and the second barrier layer comprises a geocomposite clay liner comprising a second geosynthetic membrane and a clay liner, the clay liner being positioned intermediate the first and second geosynthetic membranes and the spacer means being positioned intermediate the first membrane and the clay liner to space the said membranes apart, thereby defining the fluid passageway between the first membrane and the clay liner.

33. A method as claimed in claim 32, in which the second geosynthetic barrier layer overlies the first geosynthetic membrane.

34. A method as claimed in claim 33, in which the first and second geosynthetic membranes are peripherally sealed to each other.

35. A method as claimed in claim 30, in which the spacing means comprises a drainage layer of at least one non-synthetic material.

36. A method as claimed in claim 30, in which the spacing means is of a geosynthetic material.

37. A method as claimed in claim 36, in which the spacing means comprises a cuspated membrane of a plastics material.

38. A method as claimed in claim 30, in which the fluid is displaced by means of a fluid displacement means connected to the outlet of the fluid passageway, the fluid displacement means being operable to provide a negative pressure at the outlet with respect to the pressure at the inlet, thereby to displace the fluid through said fluid passageway from the inlet to the outlet.

39. A method as claimed in claim 30, in which the fluid comprises air.

40. A method as claimed in claim 39, which includes the step of entraining a substance into an air stream provided at the inlet, to provide the fluid for displacement through the fluid passageway comprising a mixture of air and the said substance.

41. A method as claimed in claim 40, in which the substance is water.

42. A method as claimed in claim 30, which includes the step of controlling the temperature of the fluid introduced at the inlet of the fluid passageway.

43. A method as claimed in claim 30, which includes the step of disposing of the fluid and any contaminants entrained therein extracted at the outlet.

44. A method for flushing contaminants from a geosynthetic barrier comprising at least two barrier layers, at least one of which is a geosynthetic barrier layer, and having a fluid passageway having an inlet and an outlet defined therebetween, the method including providing, regularly, a negative pressure at the outlet with respect to the inlet, thereby displacing, regularly, a fluid through said fluid passageway to entrain contaminants that have penetrated a barrier layer in a fluid flowstream.

45. A method for hydrating a clay liner of a geosynthetic barrier comprising at least two barrier layers, at least one of which is a geosynthetic barrier layer and one of which includes a clay liner, the barrier layers having a passageway having an inlet and an outlet defined between the clay liner and the other of the barrier layers, the method including providing, regularly, a negative pressure at the outlet with respect to the inlet, thereby displacing, regularly, a hydrating fluid through the fluid passageway defined between the clay liner and the other of the barrier layers.

46. A method as claimed in claim 44, in which both of the barrier layers are geosynthetic barrier layers.

47. A method as claimed in claim 45, in which both of the barrier layers are geosynthetic barrier layers.

48. A method as claimed in claim 30, in which both the first and the second barrier layers are geosynthetic barrier layers.

49. A method for constructing and operating a geosynthetic barrier, the method including providing a first barrier layer;

providing a second barrier layer, at least one of the first and second barrier layers being a geosynthetic barrier layer;

providing spacer means intermediate the first and second barrier layers to space the said barrier layers apart, the first and second barrier layers thereby defining a fluid passageway and the fluid passageway having an inlet and an outlet; and providing, substantially continuously, a negative pressure at the outlet with respect to the inlet, thereby displacing, substantially continuously, a fluid through said fluid passageway from the inlet to the outlet.

50. A method as claimed in claim 49, in which both of the barrier layers are geosynthetic barrier layers.

51. A method as claimed in claim 49, in which the negative pressure is provided continuously, thereby displacing, continuously, the fluid through the said fluid passageway from the inlet to the outlet.

52. A method as claimed in claim 51, in which both of the barrier layers are geosynthetic barrier layers.

53. A method for flushing contaminants from a geosynthetic barrier comprising at least two barrier layers, at least one of which is a geosynthetic barrier layer, and the barrier layers having a fluid passageway having an inlet and an outlet defined therebetween, the method including providing, substantially continuously, a negative pressure at the outlet with respect to the inlet, thereby displacing, substantially continuously, a fluid through said fluid passageway to entrain in a fluid flow stream contaminants that have penetrated a barrier layer.

54. A method as claimed in claim 53, in which the at least two barrier layers are geosynthetic barrier layers.

55. A method as claimed in claim 53, in which the negative pressure is provided continuously, thereby displacing, continuously, the fluid through the said fluid passageway from the inlet to the outlet.

56. A method as claimed in claim 55, in which the at least two barrier layers are geosynthetic barrier layers.

57. A method for hydrating a clay liner of a geosynthetic barrier comprising at least two barrier layers, at least one of which is a geosythetic barrier layer and one of which includes a clay liner, the barrier layers having a passageway having an inlet and an outlet defined between the clay liner and the other of the barrier layers, the method including providing, substantially continuously, a negative pressure at the outlet with respect to the inlet, thereby displacing, substantially continuously, a hydrating fluid through the fluid passageway defined between the clay liner and the other of the barrier layers.

58. A method as claimed in claim 57, in which the at least two barrier layers are geosynthetic barrier layers.

59. A method as claimed in claim 57, in which the negative pressure is provided continuously, thereby displacing, continuously, the fluid through the said fluid passageway from the inlet to the outlet.

60. A method as claimed in claim 59, in which the at least two barrier layers are geosynthetic barrier layers.

* * * * *